United States Patent [19]

Blair

[11] 4,295,756

[45] Oct. 20, 1981

[54] FLOATING BOOM END CONNECTORS

[75] Inventor: Russell M. Blair, Westport, Conn.

[73] Assignee: Slickbar, Inc., Southport, Conn.

[21] Appl. No.: 32,748

[22] Filed: Apr. 24, 1979

[51] Int. Cl.[3] ..... E02B 15/04

[52] U.S. Cl. ..... 405/70; 24/201 HH; 405/72

[58] Field of Search ..... 405/63, 70, 72; 160/392, 395; 24/84 R, 201 HH

[56] References Cited

U.S. PATENT DOCUMENTS

| | | | |
|---|---|---|---|
| 2,255,581 | 9/1941 | Ewing | 160/392 |
| 3,251,104 | 5/1966 | Sylvester | 24/84 R X |
| 3,848,417 | 11/1974 | Smith et al. | 405/70 |
| 3,991,806 | 11/1976 | Abell | 160/395 X |
| 4,030,304 | 6/1977 | West | 405/70 |
| 4,155,664 | 5/1979 | Acheson | 405/70 X |

*Primary Examiner*—David H. Corbin

*Attorney, Agent, or Firm*—Robert H. Ware; Melvin I. Stoltz; Alfred A. Fressola

[57] ABSTRACT

A floating boom end connector, for joining the end of an elongated floating material containment boom to the juxtaposed end of a similar boom or to a towing or anchoring plate, incorporates a vertically elongated extrusion having a central web portion joined to the vertically arrayed flat boom fin end by means of an enlarged vertical central cavity within which the fin end is firmly anchored by being bent and re-curved around a central core, or is wedged between two flanking wedging bars secured to the fin end inside the cavity. The end connectors are provided with interfitting scraph jaws locking together two mating connectors or one connector and a mating towing plate.

7 Claims, 3 Drawing Figures

FLOATING BOOM END CONNECTORS

This invention relates to floating booms for the containment of spilled oil and other floating debris or contaminants, and more particularly to end connector assemblies for high strength, heavy duty booms.

Towing loads and surge forces produced by current, wind gusts and surf impose significant stretching forces upon floating oil containment booms. Heavy, rugged booms of polymer materials have generally required lengthwise reinforcement by webbing or tension-carrying cables to avoid tearing the long boom segments under shock loading, as summarized in U.S. Pat. No. 3,146,598. End connections adapted for carrying endwise boom-deployment towing loads must spread these loads uniformly over the cross sectional area of the boom to avoid tearing or rupturing the boom structure at points of stress concentration. FIGS. 10 and 11 of U.S. Pat. No. 3,848,417 illustrate an effective end connector assembly employing engageable raked scarph jaws secured together over the entire vertical height of the boom, blocking leakage of contained floating contaminants while transmitting high surge forces lengthwise with maximum efficiency through the connector assembly and into a stranded stainless steel reinforcing cable clamped along the length of each boom segment.

Recent deveopments in high strength synthetic fibers, such as "KEVLAR® 29" aramid fibers marketed by the DuPont Company of Wilmington, Delaware have allowed the manufacturers of polymer-impregnated fabrics to achieve tensile strengths as high as 1,000 pounds per inch. Oil boom fins fabricated of such impregnated woven fabrics can thus resist shock loads as high as 12,000 to 36,000 pounds, depending on fin height. This permits sturdy, heavy duty oil booms to be made without the reinforcing cables disclosed in U.S. Pat. No. 3,149,598, avoiding the extra cost and weight added by such stainless steel cables, the abrasion of cables against boom fins, and the risk of snagging flotsam in cables, which has sometimes resulted in abrasion or puncturing of boom fins.

Reliance on the boom itself to carry tensile and shock loads makes doubly important the uniform distribution of tensile forces over the entire vertical height of end connector assemblies. The boom fin fabric must be merged with and anchored to the end connector in a way offering uniform load distribution, while also blocking leakage of floating contaminants, which may range from thick floating sludge and crude oil to volatile aromatics.

The floating boom end connectors of this invention are specifically designed to meet these objectives. They are preferably formed of extruded aluminum in lengths corresponding to the overall vertical height of the floating boom fin. They each have a scarph jaw raked backward, away from the adjoining mating connector for quick connection and disconnection with total interchangeability, and with one or more locking pins to avoid inadvertent disconnection during use. They incorporate a fin-anchoring cavity flanked by fin gripping portal flanges, cooperating with one or more retainer plugs to grip the boom fin firmly inside the end connector assembly.

Accordingly, a principal object of the present invention is to provide end connector assemblies for floating booms, capable of transferring high lengthwise tension loads from the thin flat boom fin through the connector to a towing cable or to an adjoining floating boom segment while preserving the structural integrity of the fin and assuring maximum resistance to leakage of floating contaminants between mated boom segments.

Another object of the invention is to provide such floating boom end connectors firmly achored to the end of a thin flat boom fin in a manner which distributes tensile and shock loads effectively over the height of the fin.

A further object of the invention is to provide such floating boom end connectors with fin-anchoring capability minimizing tensile stress concentrations which might otherwise create tearing stress at particular points in the boom fin.

Other objects of the invention will in part be obvious and will in part appear hereinafter.

The invention accordingly comprises the features of construction, combinations of elements, and arrangements of parts which will be exemplified in the constructions hereinafter set forth, and the scope of the invention will be indicated in the claims.

For a fuller understanding of the nature and objects of the invention, reference should be had to the following detailed description taken in connection with the accompanying drawings.

THE DRAWINGS

DISCLOSURE OF INVENTION

The floating boom end connector assemblies of this invention transmit tension loads effectively because their cooperating structural features co-act in a unique way to produce an unexpected new result: floating booms whose thin flat vertical fins carry the entire longitudinal boom tension, making tension reinforcement cables and webs unnecessary.

Floating booms for containing oil spills and other floating contaminants customarily incorporate one or more elongated fins of sheet polymer, often fabric reinforced, held upright by a series of buoyant floats spaced along the upper fin edge and ballasted by ballast weights spaced along the lower fin edge. When deployed in a flowing stream or tidal current, or towed to surround and contain a spill, normal loading stretches the elongated fin in tension.

Transmission of these tensile loads from the boom fin itself to the end connectors, employed to join one boom segment with the next boom segment or with a towing plate, depended upon the tension-carrying reinforcing cable in prior booms such as those disclosed in U.S. Pat. Nos. 3,146,598 and 3,848,417. The high strength woven synthetic fiber fabrics achieved with such sturdy fibers as "KEVLAR® 29" fibers of the DuPont Company have produced polymer-impregnated fabrics achieving high tensile strengths, and capable of carrying the boom tension in the fabric itself, without the need for reinforcing webs or cables. In order to transmit the tension from such a high strength, tension carrying fin into an end connector, a unique form of tension transmitting junction between fin and connector is required.

In the preferred embodiments of the present invention, a new boom-fin junction of this kind is achieved by extending the free end of the polymer impregnated fabric boom fin through an entrance portal slot into an enlarged cavity in the connector bracket, around a central core larger than the portal slot, and back out through the portal slot. Fastenings extending across the portal slot may serve to secure the doubled free end of the fin fabric therein if desired, and core-securing adhesives or fastenings may also be employed. An alternative embodiment of the invention used with thick fin fabrics may incorporate a split core having tapered cam core pieces serving to transmit the tensile load from the thick fin through the core pieces and into the connector itself.

BEST MODE FOR CARRYING OUT THE INVENTION

Figure 1:
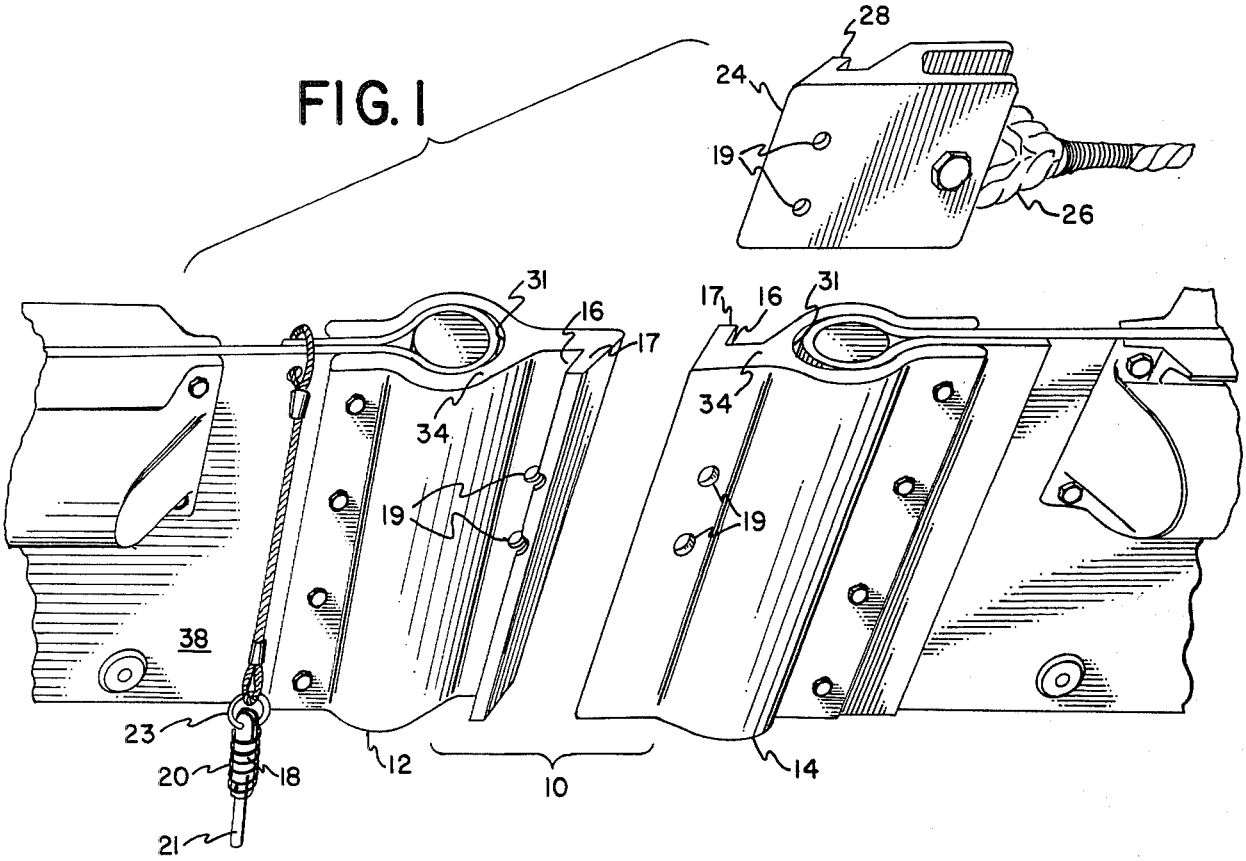
FIG. 1 is a top perspective view of an end connector assembly joining the ends of two oil boom segments together, showing an alternative detachable towing plate interchangeably employed with either of the connector brackets of the invention.
Figure 2:
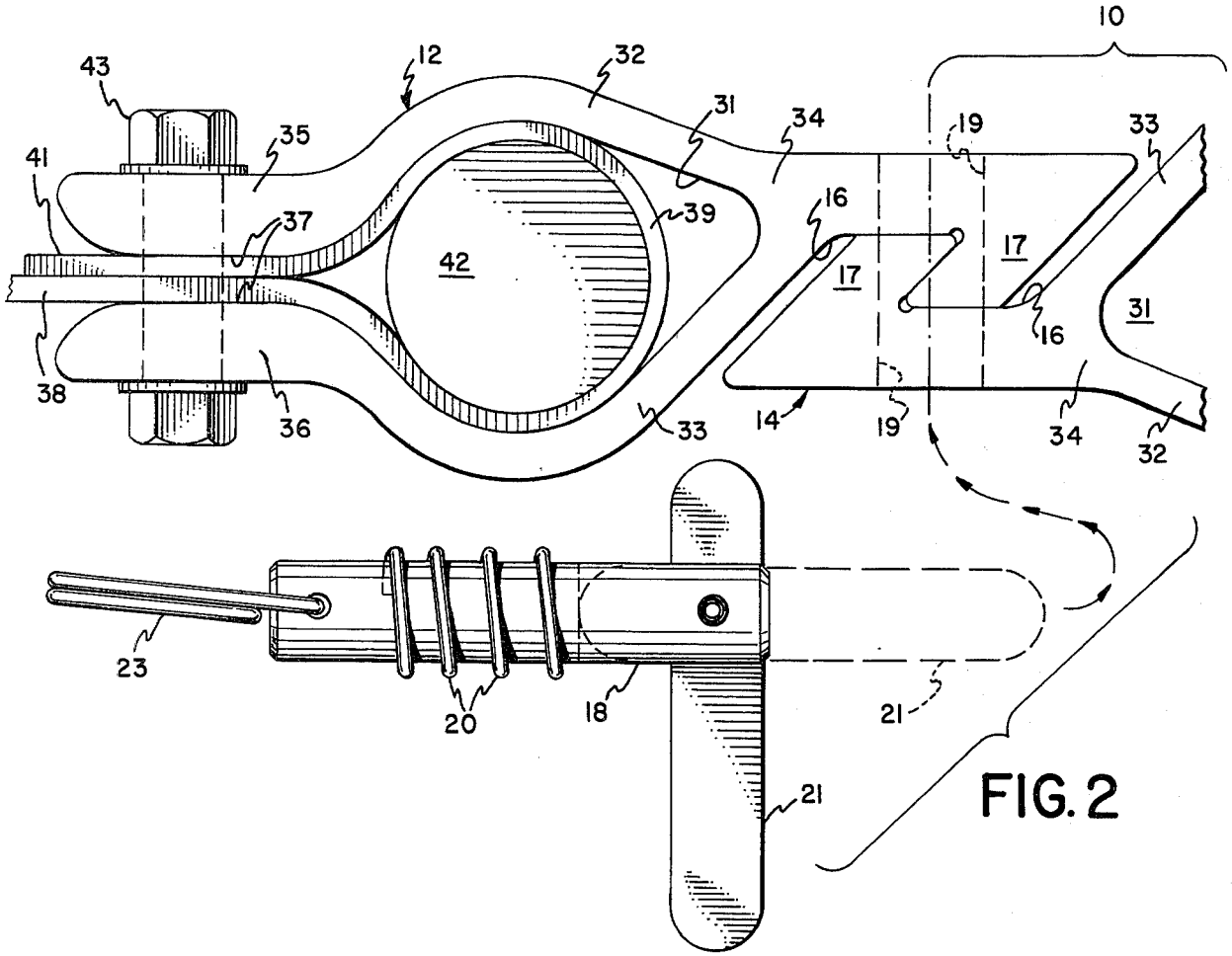
FIG. 2 is a top plan view of a connector bracket of the invention, with a fragmentary top plan view of a mating connector bracket being advanced for mating engagement.
Figure 3:
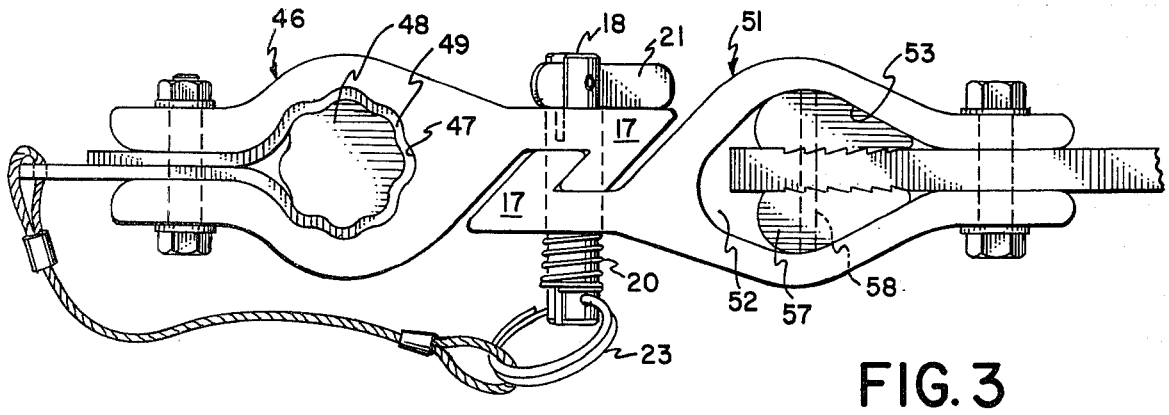
FIG. 3 is a top plan view of two connector brackets each employed in alternative embodiments of the invention, and shown installed in mating, load-carrying engagement.

Connector assembly 10 as shown in FIG. 1 incorporates two interengaging connectors 12 and 14 which are preferably formed of extruded aluminum from the same extrusion die with the preferred cross-section illustrated in FIG. 2. Each connector or bracket 12 and 14 incorporates a longitudinally extending recessed groove 16 bounded by a laterally extending jaw 17 forming the free end of the boom and connector assembly. The recess 16 and jaw 17 of each connector bracket mate with the similar recess and jaw of the next adjacent connector bracket to provide for positive interlocking of the two connectors 12 and 14 together, as indicated in FIG. 3. Recess 16 is angularly constructed to require unloading of tension and longitudinal shifting of brackets 10 and 12 before disconnection can occur.

A removable pin 18 is positioned in a perpendicularly extending hole passing through both of the engaged brackets 12 and 14, forming a single coaxial passageway through both bracket jaws in their engaged position, as shown in FIG. 3. Pin 18 prevents any unwanted longitudinal shifting of connectors 12 and 14. Undesired slippage of pin 18 is prevented by a toggle bar 21 pivoted in the forked end of the pin 18, which may be swung into a coaxial forwardly extending position shown in dashed lines in FIG. 2 for penetration through the aligned holes 19, and then may be pivoted laterally to the transverse position shown in solid lines in FIGS. 2 and 3 where it is retained against the exposed face of jaw 17 by a compression coil spring 20 encircling its opposite end, bearing against the exposed face of the opposite engaged jaw of the mating connector, and applying outward pressure against a cotter ring 23 installed through pin 18, thus tending to draw the toggle bar 21 tightly against the exposed face of the opposite jaw, thereby preventing inadvertent removal of pin 18.

To avoid loss of pin 18, its cotter ring 23 is preferably attached to boom fin 38 by a lanyard 25, as shown in FIG. 3.

A towing plate 24 also shown in FIG. 1 accommodates a shackle or eyesplice 26 providing efficient means for secured attachment of a tow line 27 to allow rapid deployment of the floating boom. Towing plate 24 is provided with a laterally extended jaw 28 and pin apertures 19, permitting the plate 24 to be engaged with the jaw 17 of any connector 12 and held in place thereon by one or more pins 18, adapting that connector boom end for towing of the entire assembled boom.

It is preferred that the extrusions forming connectors 12 and 14 be constructed so that the central plane of the connectors passes directly through the cooperating interlocking jaws 17 thereof, as indicated in FIG. 3, thus forming a direct planar extension of the central plane of the boom fins joined by the two connectors.

The junction of a tension-carrying fin with the extruded connector itself is shown in detail in FIG. 2. An enlarged central cavity 31 is formed in the mid portion of each extruded connector 12 or 14, and is bounded by sidewalls 32 and 33 diverging from a central web 34. The opposite or distal end of web 34 forms the base of recess 16 and terminates in the angularly rearwardly raked distal jaw 17 protruding from the web 34 in a lateral direction. The diverging sidewalls 32 and 33 embracing the central cavity 31 reach their maximum divergence at the widest width of cavity 31 and then reconverge, smoothly blending into spaced apart proximal end flanges 35 and 36 forming between themselves a portal slot 37. The width of portal slot 37 is preferably slightly more than twice the thickness of the oil boom fin 38.

As indicated in FIG. 2, the free end of fin 38 extends into portal slot 37 and then recurves in a U-shaped bight portion 39 inside cavity 31, extending around the interior of sidewalls 33 and 32 and out again through portal slot 37, with its free end 41 protruding beyond the connector 12. A large cylindrical central core 42 is positioned inside bight portion 39 of the boom fin 38 inside cavity 31. Core 42 may be formed of wood, solid or hollow metal tubing, or polymer foam material, which may be foamed in place if desired, preferably forming a relatively rigid central core 42. After installation of the fin 38 around core 42 within cavity 31 to form the tension transmitting junction with the extruded connector 12, tension is placed on boom 38 to draw bight portion 39 and core 42 snugly against the converging portions of sidewalls 32 and 33 toward portal slot 37, and bolts 43 or similar through fastenings such as rivets are installed through suitable apertures in the end flanges 35 and 36, extending directly through the fin portions 38 and 41 positioned within portal slot 37 between end flanges 35 and 36 to secure the fin firmly within the connector 12. Core 42 prevents relative longitudinal movement of the fin portions 38 and 41 in portal slot 37, minimizing stress concentrations at the through fastenings 43 and avoiding the hazard of tearing the boom fin material at these points.

The United States Navy has tested a boom fin end connector with a wedging double post device interfitting with an open semicircular groove in a connector bracket, but this does not foreshadow the connectors of this invention, with a narrow entrance portal slot 37 opening out into a broad central anchoring cavity 31.

Whether two similar boom ends are joined by connectors such as connectors 12 and 14 shown in FIG. 1, or the towing plate 24 is installed on end connector 12, the tension load carried by boom fin 38 is transmitted directly through the bight portion 39 of the boom fin 38 bearing upon the recoverging sidewall portions 32 and 33 of connector 12 to transmit this tensile load with high efficiency to the connector jaw 17. In one tension loading test carried to failure on a boom with a 14" fin 38 and connector 12 engaged to a 7" high tow plate 24, increasing tension loads were carried by the entire assembly until the tow plate broke at a load of 12,400 pounds. At this point, tension load carried by the polymer impregnated "KEVLAR®29" woven fabric boom fin had reached 885 pounds per inch of fin height, and the fabric remained unaffected by this tension load.

In a preferred embodiment of this invention, the fabric met the following specification values:

| Boom Fin Fabric Specifications | | |
|---|---|---|
| BASE FABRIC | | |
| Weight P.S.Y., oz. | 7.8 | |
| Fiber | Kevlar | |
| Denier | 3000 | |
| Fabric Count | Warp 10, Fill 10 | |
| COATED FABRIC | | |
| Total Wt. (ozs. P.S.Y.) | 35 | |
| Type of Coating | Face: Urethane<br>Back: Urethane | |
| Coating Distribution | Face 70% -<br>Back 30% | |
| Color | Black | |
| Width | 60 + ½ Inches | |
| Sealing Properties | Dielectric and Thermal | |
| MECHANICAL PROPERTIES | | Fed. Std. 191 Method |
| Tensile Strength, 1" strip lbs. | Warp 1000 - Full 800 | 5102 |
| Adhesion of Coating | 150 Lbs. | 5970 |
| Adhesion, Thermal Seal, per 2" | 350 Lbs. | |
| Tear Strength, tongue lbs. | Warp 450 - Fill 450 | 5134.1 |
| Hydrostatic (lbs. p.s.i.) | 600+ | 5512.1 |
| Low Temperature, Fahrenheit | −65 + 2° F. | |
| Abrasion Resistance (taber) | 10,000 + Cycles | 5306 |
| To Exposure of Fabric | Wheel CS17 -<br>Gram Load 1000 | |
| Elongation at Break, 1" strip | Warp 2% - Fill 2% | 5102 |
| Blocking Resistance Rating | 2 | 5872 |
| Accelerated Weathering | 300 Hrs/excellent | |
| Oil Resistance | Mil-C-20696B - good | 4.4.3. |
| Hydrocarbon Resistance | Mil-C-20696B - excellent | 4.4.4. |
| Gauge, Mils | 35 | |

Two modified versions of the floating boom end connectors of the present invention are shown connected in tension-transmitting engagement in FIG. 3. At the left side of FIG. 3 is a connector 46 having a lobed or corrrugated central cavity 47 and a correspondingly lobed core 48, with the bight portion 49 of the boom fin sinuously embraced between the lobed cavity 47 and the lobed core 48, increasing the tractive engagement of core 48 and fin bight 49. The recessed groove 16 and raked jaw 17 of connector 46 are the same as those of connectors 12 and 14 of FIGS. 1 and 2.

On the right hand side of FIG. 3, there is shown a still further modified connector embodiment 51 in which the coverging sidewall portions forming the proximal region of the central cavity 52 converge more gently at a more acute angle than those of the other embodiments, forming a wedge shaped gripping portion 53 of the cavity 52. This embodiment of the connectors of the present invention is well adapted to receive a broad thick boom fin 54, whose free end is inserted between two mating tapered cam core pieces 56 and 57, whose facing surfaces are ridged, knurled or barbed in a sawtooth pattern for increased tractive engagement with the outer surfaces of the thick fin 54, all as shown by FIG. 3. The two tapered cam core pieces 56 and 57 may be held in engagement with the free end of fin 54 by a roll pin or similar fastening shown by dashed lines 58 in FIG. 3. Tensile load on fin 54 tending to pull it away from the jaw 17 of connector 51 draws core pieces 56 and 57 toward the converging sidewalls forming the acutely converging gripping portion 53 of central cavity 52, firmly anchoring thick fin 54 within connector 51 in a sturdily conjoined assembly.

Both the single solid core 42 of FIG. 2 and the divided tapered cam core bars 56 wedged in cavity 52 shown in FIG. 3 serve to anchor the boom fin solidly inside the connector bracket. Tensile loads on the boom fin actually enhance the anchoring forces, thus assuring the sturdy integrity of the booms of this invention.

It will thus be seen that the objects set forth above, among those made apparent from the preceding description, are efficiently attained and, since certain changes may be made in the above constructions without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A tension transmitting connector for the end of a flat vertically arrayed fin of an elongated floating material containment boom, for joining said end thereof to a tension-applying towing or anchoring plate or to the juxtaposed end of a similar boom, comprising:

A. a vertically elongated central tow flange portion juxtaposed to said flat fin end and incorporated a distal engaging portion for interlocking engagement with the adjacent distal towing plate or anchoring plate of an adjacent connector, wherein the engaging portion comprises a raked, tension-carrying scarph jaw forming a scarph joint interlocking the tow flange with a mating scarph jaw of a tow flange of the adjacent connector;

B. two intermediate vertically elongated sidewall portions extending laterally divergingly from the central flange portion to define an enlarged vertical central cavity embracing the vertical fin end and reconverging to form facing proximal end flanges sandwiching the fin end therebetween in a narrow vertical proximal entrance portal slot; and c. a vertically elongated anchoring core positioned inside the central cavity co-acting with the fin end and blocking its withdrawal through the portal slot.

2. The connector defined in claim 1, wherein the anchoring core is a vertical bar positioned within the vertical central cavity, with the flat fin end extending into and through the portal slot, curving around and encircling the bar between the bar and the sidewalls and re-emerging through the portal slot, thus forming a bight portion whose withdrawal through the portal slot is blocked by the bar encircled by the bight portion.

3. The connector defined in claim 2, wherein the facing surfaces of the vertical bar and the sidewalls are formed with traction surfaces engaging the fin end bight portion therebetween.

4. The connector defined in claim 2, wherein the sidewalls bounding the central cavity are formed in a wavy corrugated configuration with undulating vertical lobes, and wherein the vertical bar is correspondingly lobed to force the fin end bight portion into tractive engagement with the sidewall lobes.

5. The connector defined in claim 1, wherein the fin end projects directly through the portal slot into the central cavity without curving, and wherein the anchoring core is divided into two vertical wedging bars secured to the fin end and flanking the fin end inside the central cavity, blocking withdrawal of the fin end through the portal slot by wedging jamming engagement with the sidewalls bounding the central cavity.

6. The connector defined in claim 5, wherein the wedging bars are provided with traction surfaces engaging the flat fin end therebetween.

7. The connector defined in claim 1, wherein the facing end flanges are drawn together to compress the boom fin end therebetween by through bolt means.

* * * * *